US008567652B2

(12) United States Patent
Di Stasio et al.

(10) Patent No.: US 8,567,652 B2
(45) Date of Patent: Oct. 29, 2013

(54) REVERSIBLE BACKPACK

(75) Inventors: Adriano Di Stasio, Leini (IT); Aldo Di Stasio, Leini (IT)

(73) Assignee: SEVEN S.p.A., Leini (Turin) (IT)

( * ) Notice: Subject to any disclaimer, the term of this patent is extended or adjusted under 35 U.S.C. 154(b) by 687 days.

(21) Appl. No.: 12/663,600

(22) PCT Filed: Jun. 8, 2007

(86) PCT No.: PCT/IT2007/000409

§ 371 (c)(1),
(2), (4) Date: Oct. 12, 2010

(87) PCT Pub. No.: WO2008/149395

PCT Pub. Date: Dec. 11, 2008

(65) Prior Publication Data

US 2011/0024474 A1 Feb. 3, 2011

(51) Int. Cl.
*A45F 3/04* (2006.01)
*A45C 15/00* (2006.01)

(52) U.S. Cl.
USPC ..... 224/645; 224/579; 224/578; 224/627

(58) Field of Classification Search
USPC ..... 224/645, 581, 604, 657, 627, 578, 579, 224/580, 153; 150/103
See application file for complete search history.

(56) References Cited

U.S. PATENT DOCUMENTS

| | | | | |
|---|---|---|---|---|
| 5,361,951 | A * | 11/1994 | Chehebar | 224/153 |
| 5,660,312 | A * | 8/1997 | Suzuki | 224/627 |
| 5,927,575 | A * | 7/1999 | Gatling | 224/153 |
| D413,733 | S * | 9/1999 | Edmonds | D6/336 |
| D432,298 | S * | 10/2000 | Markowitz | D3/217 |
| 6,216,926 | B1 * | 4/2001 | Pratt | 224/153 |
| 7,617,956 | B1 * | 11/2009 | Sabbah | 224/153 |
| 2003/0121942 | A1 | 7/2003 | Chang | |
| 2004/0065708 | A1 | 4/2004 | Amram | |
| 2004/0209018 | A1 | 10/2004 | Lookholder | |

FOREIGN PATENT DOCUMENTS

| | | |
|---|---|---|
| JP | 2006-141883 | 6/2006 |
| JP | 2006-296560 | 11/2006 |
| WO | WO 97/49312 | 12/1997 |

OTHER PUBLICATIONS

Japanese Patent Office Action issued Jul. 10, 2012, in connection with Japanese Patent Application No. 2010-510966, and its English translation.
International Search Report for PCT/IT2007/000409 mailed Feb. 8, 2008.
International Preliminary Report on Patentability for PCT/IT2007/000409 dated Sep. 22, 2009.

* cited by examiner

*Primary Examiner* — Nathan J Newhouse
*Assistant Examiner* — Matthew Theis
(74) *Attorney, Agent, or Firm* — Nixon & Vanderhye P.C.

(57) ABSTRACT

The present invention relates to a reversible backpack comprising at least one wall and at least two shoulder straps (43) to carry the backpack (10), attached to the wall. The wall comprises, on opposite sides and on a area above the wall, first (31*a*) and second hooking elements designed to be hooked alternatively to correspondent first hooking means (61) attached to first ends (51) of said shoulder straps (43) and on opposite sides and on an area lower than the wall (21), third (33*a*) and fourth hooking means designed to be hooked alternatively to correspondent second hooking means (62) attached to second ends (53) of said shoulder straps (43). The invention also relates to a couple of shoulder straps (43) for a backpack and to a reversible body (12) for a backpack.

2 Claims, 4 Drawing Sheets

REVERSIBLE BACKPACK

This application is the U.S. national phase of International Application No. PCT/IT2007/000409 filed 8 Jun. 2007 which designated the U.S., the entire contents of which is hereby incorporated by reference.

FIELD OF INVENTION

The present invention relates to a reversible backpack, to shoulder straps for a reversible backpack and to a reversible body for a backpack.

Particularly, the present invention relates to a reversible backpack having two shoulder straps.

RELATED ART

Reversible backpacks with two or four shoulder straps are a known art.

Particularly, a reversible backpack with two shoulder straps is known, as described by U.S. Pat. No. 5,361,951.

This backpack comprises a compartment to contain and carry personal belongings and made of a back wall and a couple of shoulder straps attached to the back wall at their upper and lower ends.

The known backpack comprises a lower area or lumbar area and a first couple of hooking elements for the lower ends of the shoulder straps positioned on the external side of the compartment and a second couple of hooking elements for the lower ends of the shoulder straps positioned on the internal side of the compartment. The back wall of the known backpack comprises also a couple of apertures on the upper area, near the upper ends of the shoulder straps.

The backpack's reversibility is obtained by disconnecting the lower ends of the shoulder straps from the first couple of hooking elements, by passing the shoulder straps through the two apertures and by connecting the lower ends of the shoulder straps to the second couple of hooking elements.

The known solution shows overall the technical problem of requiring the presence of apertures in the backpack's compartment or bag, particularly in its upper area.

These apertures allow humidity, rain, snow or other undesired elements to penetrate inside the compartment with consequent damage to its content.

Furthermore, these apertures are an easy incentive for possible thieves intending to take possession of the compartment's content.

An additional problem of the known backpack is that the back wall, being a part of the reversible pocket and therefore subject to being manipulated to transform the backpack from a first base configuration to a reversed configuration, can become unreliable with time.

Finally, the Applicant has observed that in the technical field of reversible backpacks with two shoulder straps, the problem related to a good protection of the content of the compartment or bag from external elements or from thieves, remains unresolved.

SUMMARY OF THE INVENTION

Scope of the invention is a reversible backpack that resolves the above-mentioned problems of the known art.

The reversible backpack, as claimed, is fulfilling this scope.

The present invention also relates to a couple of shoulder straps for a reversible backpack and to a reversible body for backpacks.

The attached claims constitute an integral part of the technical teaching regarding the novelty of the invention.

According to a preferred embodiment, the novel reversible backpack comprises at least two shoulder straps, having connecting means to their ends, and a reversible body having on opposite sides and in upper and lower positions, corresponding couples of hooking means, able to be connected alternatively by said connecting means to achieve the first or second embodiment of the backpack.

According to an additional feature of the present invention, the side of the body of the backpack comprises also removable connecting means at opposite sides of the wall and designed to be alternatively connected to the corresponding connecting means attached to the shoulder straps, depending on the configuration in use.

According to another feature of the present invention, the shoulder straps are connected to a back side comprising a back side body connected to the shoulder straps.

BRIEF DESCRIPTION OF THE DRAWINGS

This and other features of the present invention will be clearer from the following description of the preferred embodiments, here described as an example and not as a limitation, in conjunction with the support of the attached drawings in which components labelled with the same or similar numerical reference represent components having the same or similar function and construction, wherein.

DETAILED DESCRIPTION OF THE PREFERRED EMBODIMENTS

Figure 1:
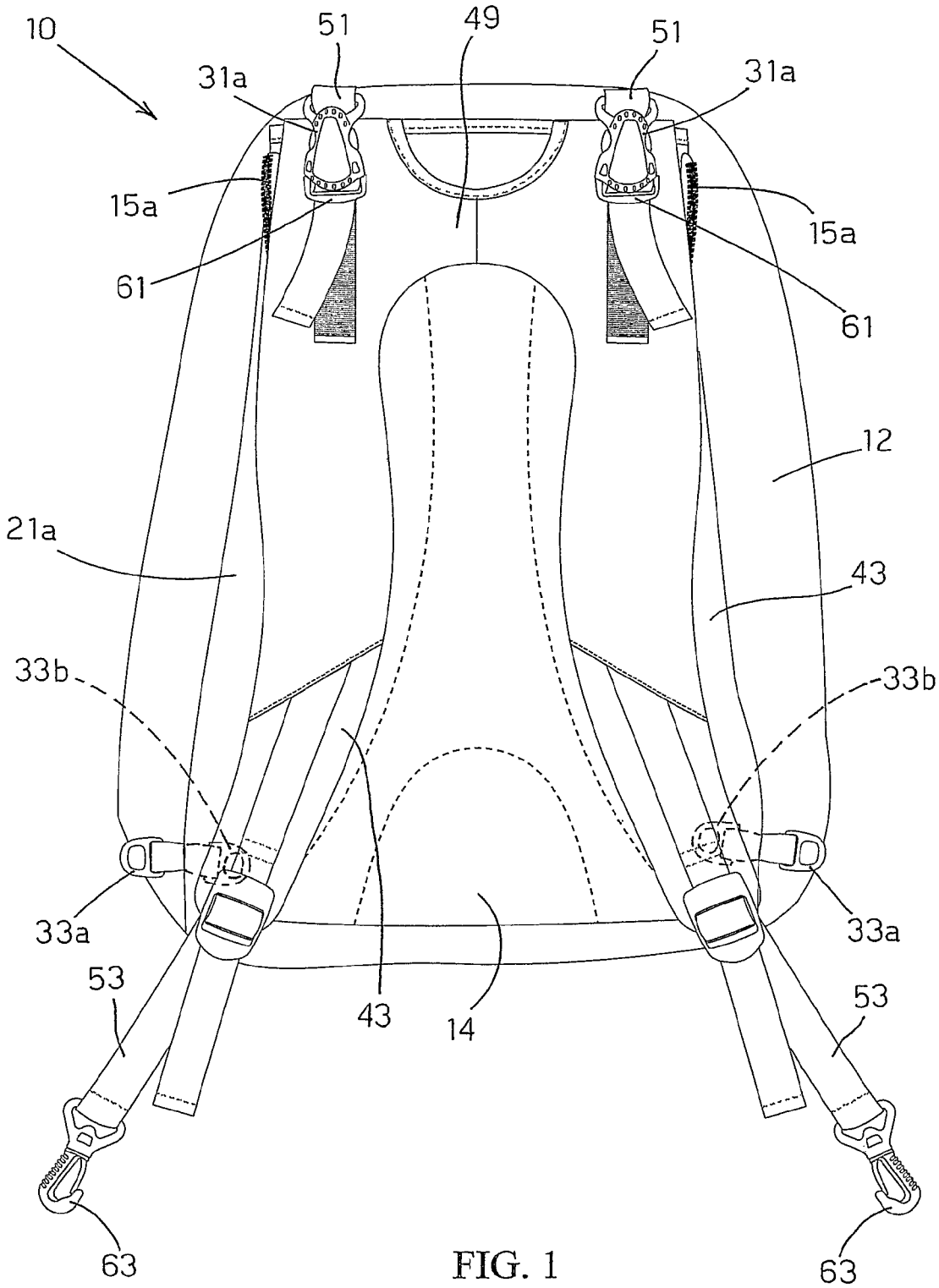
FIG. 1 represents a back view of the backpack according to the first embodiment of the invention.
Figure 2:
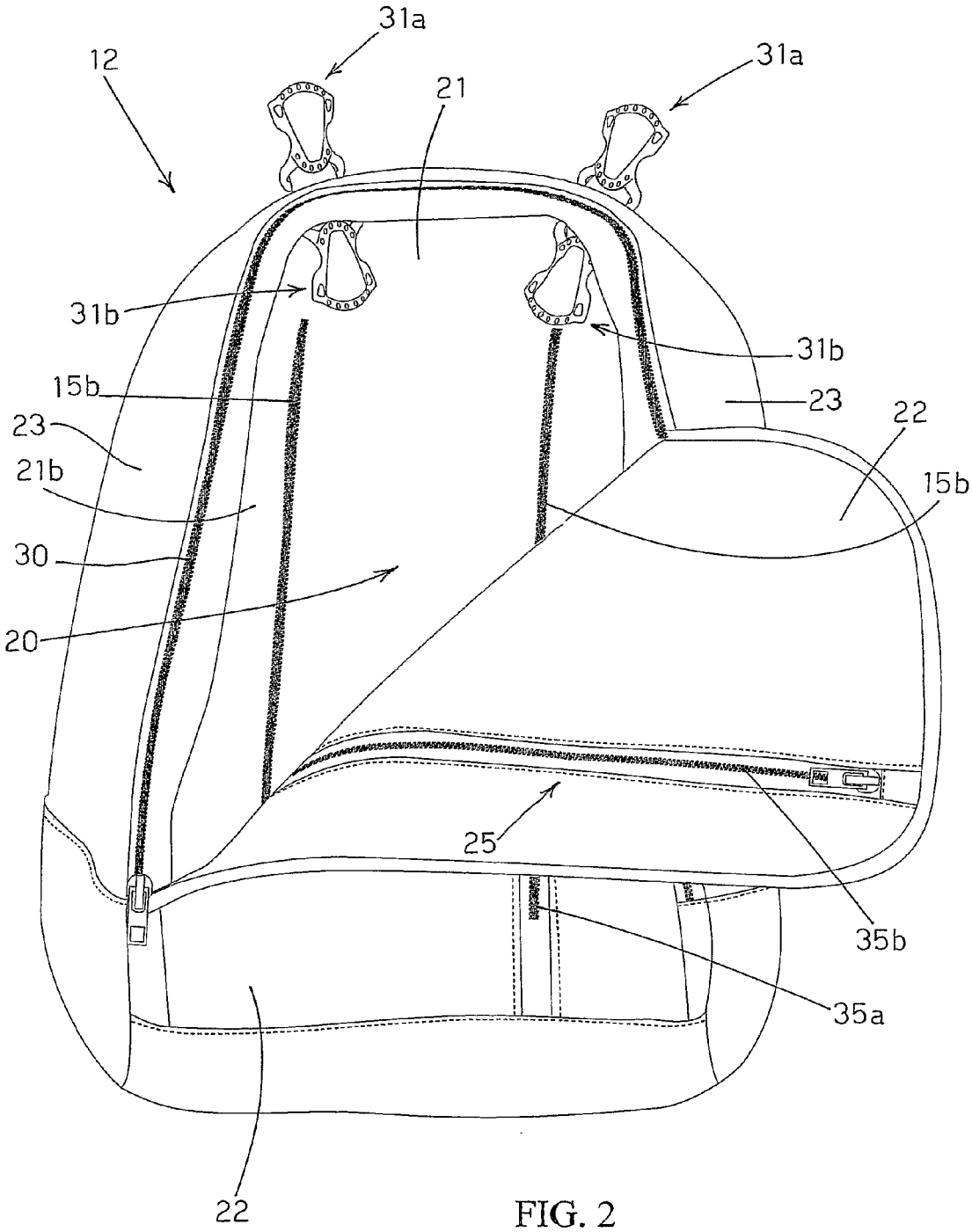
FIG. 2 represents a front view of the body of the same backpack as illustrated in FIG. 1.

With reference to FIG. 1, a backpack of reversible type 10 (backpack), according to the first embodiment of the present invention, comprises a body 12 having first and second connecting elements or connecting means, 15*a* and 15*b* (FIG. 2), a couple of shoulder straps 43 (FIG. 1, FIG. 2) and a back side 14 configured to be connected, when used, alternatively to the first or second connecting elements, 15*a* or 15*b* respectively.

The body 12 of the backpack, according to the preferred embodiment, has reversible walls, 21, 22, 23, and is designed to assume a first embodiment or preferred embodiment wherein the body shows a first side of those walls, and a second embodiment or reversed configuration, wherein the body shows a second side or opposite side of said walls.

The reversible body 12, in both embodiments, is able to assume the shape of a bag in which to insert the content to be carried; the bag, indicated with reference number 20 in the first embodiment, is accessible, for example, through an accessing zipper 30 (zipper), of known kind, designed to allow a sufficient opening to transform the backpack 10 from the first configuration to the second configuration.

In the preferred embodiment, the first wall 21 is designed to become a back wall of the bag, the second wall 22 is designed to become a front wall of the bag, the third wall 23 has opposite sides connected to the first and second wall, 21 and 22 respectively, using known stitching, and it is designed to connect the first wall 21 (back wall) to the second wall 22 (front wall) and shape the bag of the backpack 10.

In additional embodiments, the front wall 22 can be configured to become, in turn, a front pocket 25 of the backpack 10, accessible through a first zipper 35*a* or through a second zipper 35*b*, depending on the configuration of the body (12), for example, the base configuration or the reversed configuration.

Similarly, the side wall can be configured also to make lateral pockets.

The walls are made, preferably, with known materials of different colors or patterns on opposite sides of the walls.

The back wall 21 of the body 12 comprises, on a first side or on the external side 21*a*, the first connecting elements 15*a* to the back side and on an internal side 21*b*, preferably in correspondence with the first connecting elements 15*a*, the second connecting elements 15*b* to the back side; the first and second connecting elements, 15*a* and 15*b* respectively, are made preferably using a couple of zippers positioned to a predetermined distance from one another.

The back wall 21, preferably, comprises also a first couple of hooking elements 31*a*, positioned, for example, in the joining area between the back wall 21 and the lateral wall 23, correspondence with the external side 21*a* and in an upper area of the backpack 10; the back wall comprises a second couple of hooking elements 31*b* positioned, preferably, in correspondence of the first couple of external hooking elements 31*a*, but internally to the body 12.

The back wall 21 comprises also a third couple of hooking elements 33*a*, positioned, for example, in the junction area between the back wall 21 and the lateral wall 23, in correspondence with the external side 21*a* and in a lower area of the backpack 10, and a fourth couple of hooking elements 33*b*, positioned, preferably, in correspondence of the third couple of hooking elements 33*a*, but internally to the body 12.

Preferably, these hooking elements 31*a*, 31*b*, 33*a*, or 33*b* are made with equivalent couples of buckles, rings, carabiners, etc.

Figure 3:
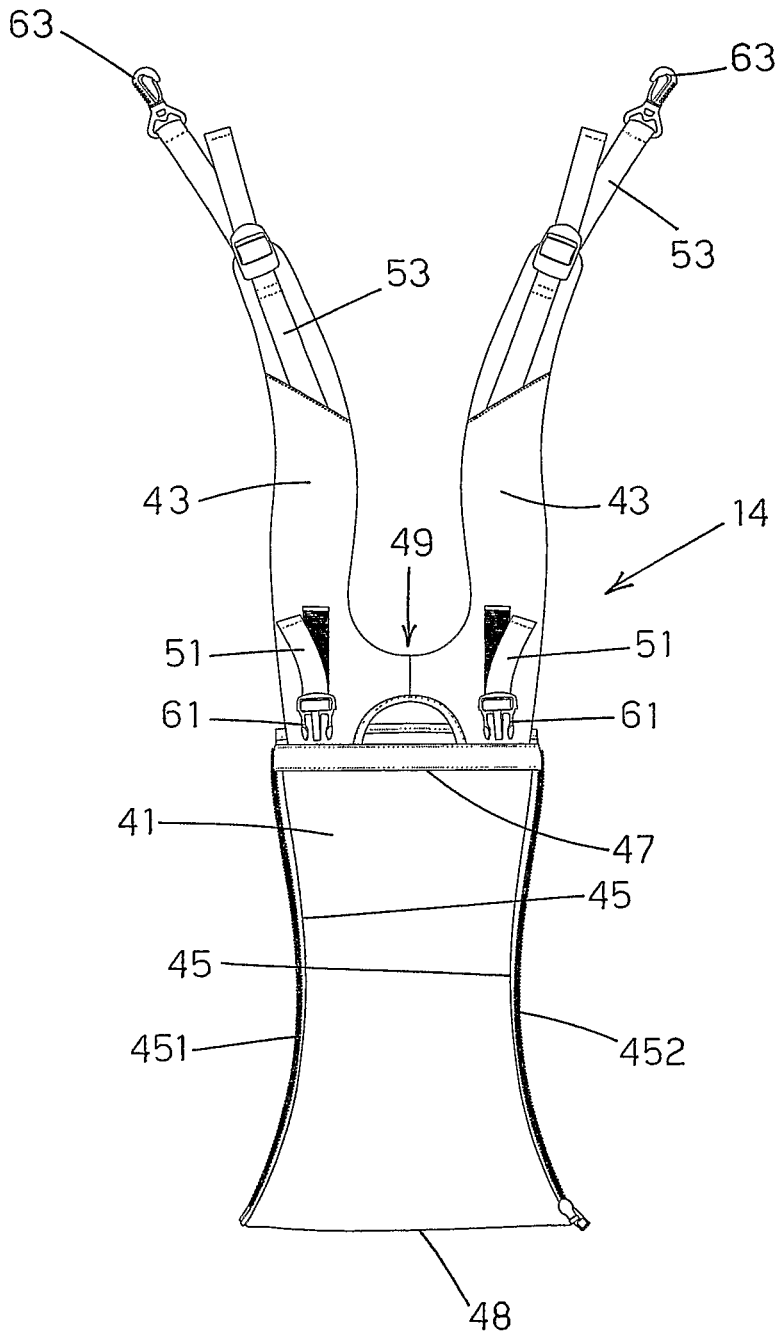
FIG. 3 represents the back side of the backpack according to the first embodiment of the invention.

The back side 14 (FIG. 3) in the preferred embodiment, comprises a back body 41 connected to the couple of shoulder straps 43.

The back body 41, preferably, has for example two flared, external, lateral edges 45, an upper edge or shoulder edge 47 and a lower edge or lumbar edge 48.

Lateral edges 45 of the back body 41 comprise respectively connecting elements or connecting means 451 and 452 configured to be connected, alternatively, to the first or second connecting elements (first or second couple of zippers) 15*a* or 15*b* (FIG. 1, FIG. 2, FIG. 3) of the body 12 of the backpack 10 depending on its configuration.

In the preferred embodiment, the couple of shoulder straps 43 are connected, using, for example, stitches of known kind to the body of the back 41 through the shoulder edge 47 and are designed to make a carrying handle 49 for the backpack.

The couple of shoulder straps comprises a first couple of belts 51 and a first couple of hooking elements or first hooking means 61, such as buckles of known kind, to a first end of the couple of shoulder straps 43.

The first couple of hooking elements (couple of buckles) 61 are designed to be connected, alternatively, to the first or second couple of hooking elements 31*a* or 31*b* of the body of the backpack 10, depending on the configuration.

The couple of shoulder straps 43 comprise also a second couple of belts 53 and a second couple of hooking elements or second hooking means 63, such as carabiners of known kind, connected to a second end of the couple of shoulder straps 43.

The second couple of hooking elements 63 (couple of carabiners) are designed to be connected, alternatively, to the third or fourth couple of hooking elements 33*a* or 33*b* of the body of the backpack 10, depending on the configuration.

Following is the operation of the reversible backpack (10). Referring, for example, to a first configuration as illustrated in FIG. 1, according to the user's need to reverse or to turn inside out the backpack 10, the user can, for example, execute the following steps:

- unhook, if connected, the couple of carabiners 63 from the third couple of hooking elements 33*a;*
- unhook, if connected, the couple of buckles 61 from the first couple of hooking elements 31*a* of the body 12 of the backpack;
- disconnect the back side 14, particularly the back body 41 from the body 12 of the backpack by disconnecting the zippers 451 and 452, respectively, from the first couple of zippers 15*a* of the back wall 21;
- open the access to the pocket 20 using the zipper 30;
- reverse the body 12 of the backpack 10 through the aperture in the pocket 20;
- connect the back side 14 to the body 12 of the backpack by connecting the zippers 451 and 452 to the second couple of zippers 15*b* of the back wall 21;
- fasten, eventually, the couple of buckles 61 to the second couple of hooking elements 31*b;*
- fasten, eventually, the couple of carabiners 63 to the fourth couple of hooking elements 33*b*.

At the end of these steps, the backpack 10 will be configured according to the reversed configuration. Obviously, the set of steps of unhooking and disconnecting or the steps of hooking and connecting can be executed in a different sequence without changing the final result.

The backpack according to the invention has been described referring to components such as zippers, buckles, carabiners, belts, etc.

As easily understood by a technician of the field, these components can be substituted with other components having equivalent functions, without deviating from the essence of the invention, as described and claimed.

For example, the zippers, generally, can be replaced by Velcro components, the buckles can be replaced by carabiners, hooks or rings, carabiners by buckles or hooks and so on.

The body 12 of the backpack 10 has been described as made by three types of walls, such as a back wall, a lateral wall and a front wall.

As easily understood by a technician of the field, in additional embodiments, the walls may be in different number and of different kind.

For example, the lateral wall can comprise a base wall and two lateral walls that could be missing, causing the front wall to be connected to the back wall.

In additional embodiments, only one wall can be present, adequately shaped and configured to make a backpack pocket.

Figure 4:
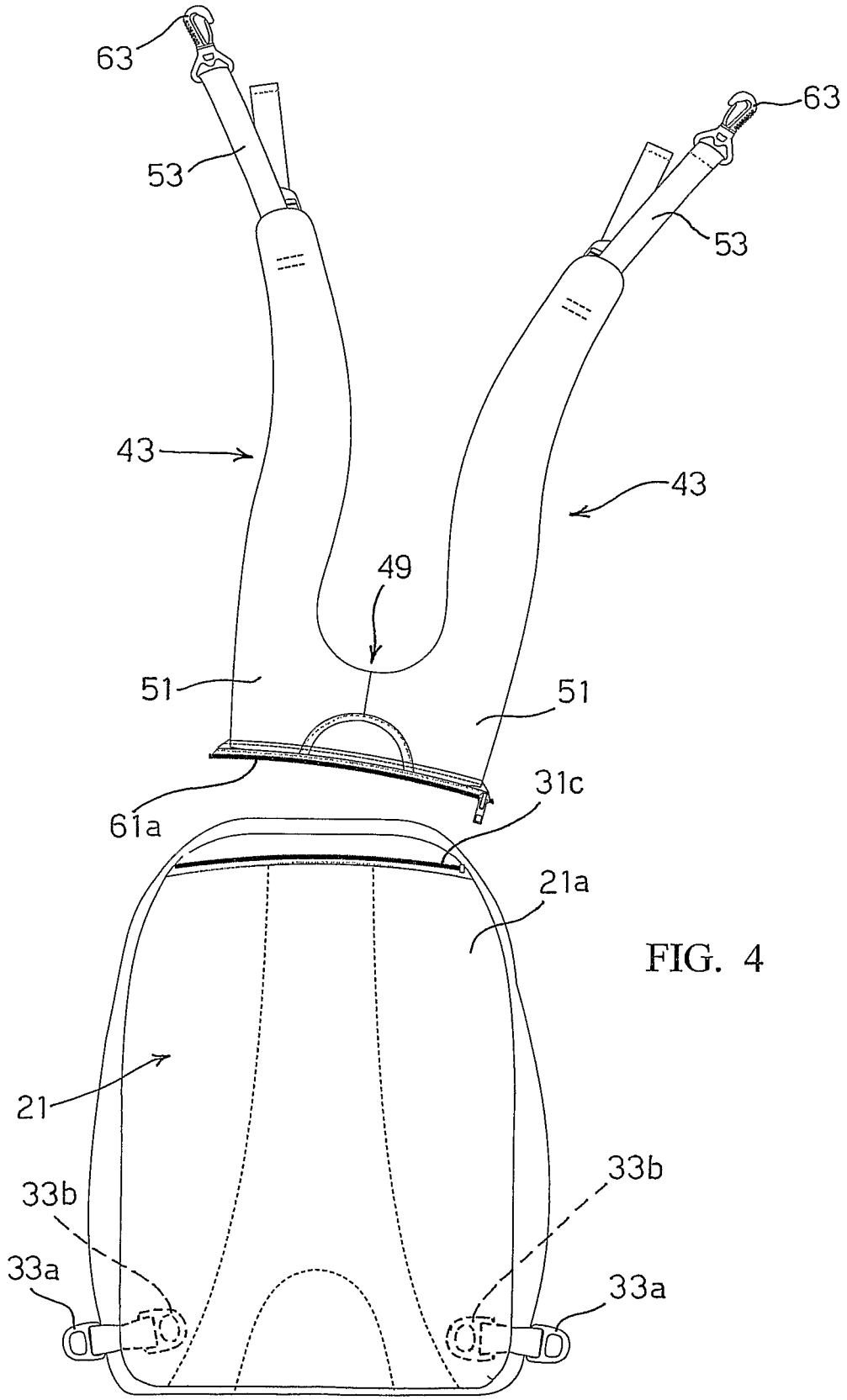
FIG. 4 represents a reversible backpack according to the second embodiment of the invention.

In additional embodiments, the shoulder straps can be configured, as easily understood by a technician of the field, to not require the presence of the back body and, consequently, the presence of the back side of the backpack. Said embodiment is represented, as an example, by FIG. 4 which shows that the back wall 21 comprises on both sides and in the upper side of the back wall, elements or hooking means 31*c*, such as a horizontal zipper, and the couple of the shoulder straps 43 comprise, at one end, a hooking element 61*a*, such as a horizontal zipper or a couple of zippers, designed to be connected to the hooking means 31*c* of the back wall.

In this embodiment, it is also designed as a further variation, that the couple of shoulder straps 43 comprise at the first end, for robustness reasons when lifting the backpack, the buckles

61 and that the back wall 21 of the backpack 10 comprises, as already described, the two couples of hooking means, 31*a* and 31*b* respectively, to operate as described.

As easily understood by a technician in the field, the second embodiment, as described, while still having the advantages of the reversibility of the backpack, does not require the presence of a back side nor the correspondent connecting elements to the back wall of the backpack.

The backpack, as described, is of simple use, does not have openings that allow easy access to the bag of the backpack, and is, at least in one of the embodiments, particularly strong while presenting a back side separable from the body of the backpack.

Furthermore, according to the first embodiment, the back side can be of non-reversible kind and set to show always the same side toward the back wall 21 of the backpack 10. This solution allows to optimize the structure of the back side independently from the quality features and structure of materials used to make the body of the backpack.

The same considerations are also applicable to the second embodiment, when the back side is not present but only the shoulder straps are present.

Obvious variations or modifications are possible to the above description, regarding the dimensions, shapes, materials, components, as well as regarding the construction details as illustrated and the operating method, without deviating from the spirit of the invention, as defined by the following claims.

The invention claimed is:

1. A reversible backpack comprising:

a body shaped as a bag having reversible walls including a first wall being a back wall having an external side and an internal side, a second wall being a front wall, and a third wall being a lateral wall, said body being configured to assume a first embodiment wherein the body shows a first side of the first, second, and third walls, and a second embodiment being a reversed configuration wherein the body shows a second side, being an opposite side, of the first, second, and third walls, at least two shoulder straps, each strap having a first end and having a second end, wherein the shoulder straps carry the body of the backpack;

a first hooking element on said external side and a second hooking element on said internal side of an upper area of said first wall, wherein said first and second hooking elements are designed to be hooked alternatively to correspondent first hooking means associated to the first ends of the shoulder straps; and a third hooking element on said external side and a fourth hooking element on said internal side of a lower area of said first wall, wherein said third and fourth hooking elements are designed to be hooked alternatively to correspondent second hooking means associated to the second ends of the shoulder straps, and wherein said external side and said internal side of said first wall are each further provided with two respective spaced-apart line fasteners;

a back body designed to operate as a back side of the backpack and connected to said couple of shoulder straps having lateral edges provided with respective line fasteners connectable in a removable way to said line fasteners provided on the external side and the internal side of said first wall.

2. A backpack according to claim 1, wherein said first, second, third, or fourth hooking elements and said first or second hooking means comprise components selected from the group consisting of:

buckles;

hooks; and locking rings.

* * * * *